US008231215B2

(12) United States Patent
Fukasaka

(10) Patent No.: US 8,231,215 B2
(45) Date of Patent: Jul. 31, 2012

(54) RECORDING MEDIUM CONVEYING DEVICE

(75) Inventor: Toshihiro Fukasaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 455 days.

(21) Appl. No.: 12/485,662

(22) Filed: Jun. 16, 2009

(65) Prior Publication Data

US 2009/0315938 A1 Dec. 24, 2009

(30) Foreign Application Priority Data

Jun. 19, 2008 (JP) ..... 2008-160298

(51) Int. Cl.
*B41J 2/01* (2006.01)

(52) U.S. Cl. ..... 347/104; 347/16; 271/193

(58) Field of Classification Search ..... 347/104, 347/105, 5, 9, 16; 271/193
See application file for complete search history.

(56) References Cited

U.S. PATENT DOCUMENTS

| | | | | |
|---|---|---|---|---|
| 6,595,515 | B2 * | 7/2003 | Numata et al. | 271/193 |
| 7,396,123 | B2 | 7/2008 | Sootome et al. | |
| 2003/0052955 | A1 | 3/2003 | Kanome | |

FOREIGN PATENT DOCUMENTS

| | | | |
|---|---|---|---|
| CN | 1706653 | A | 12/2005 |
| JP | 2003-160253 | A | 6/2003 |

* cited by examiner

*Primary Examiner* — Lam S Nguyen
(74) *Attorney, Agent, or Firm* — Canon U.S.A., Inc. IP Division

(57) ABSTRACT

An apparatus includes a belt that attracts a recording medium using electrostatic force, and a power source that applies voltage to the belt. The apparatus further includes a voltage controller that controls the voltage applied to a charging portion of the belt, and a recording controller that transmits recording medium information on the recording medium to the voltage controller. The voltage controller changes a value of voltage applied to the charging portion, according to the recording medium information transmitted from the recording controller.

9 Claims, 9 Drawing Sheets

| PAPER TYPE | VOLTAGE |
|---|---|
| PLAIN PAPER | HIGH |
| HIGH-GRADE EXCLUSIVE PAPER | HIGH |
| PHOTO PAPER | LOW |
| GLOSSY PAPER | LOW |
| POSTCARD | HIGH |
| GLOSSY FILM | LOW |
| OHP | HIGH |
| LIGHTWEIGHT COATED PAPER | HIGH |

| PAPER TYPE | VOLTAGE |
|---|---|
| PLAIN PAPER | ±1.0 kV |
| HIGH-GRADE EXCLUSIVE PAPER | ±1.0 kV |
| PHOTO PAPER | ±0.5 kV |
| GLOSSY PAPER | ±0.5 kV |
| POSTCARD | ±1.0 kV |
| GLOSSY FILM | ±0.75 kV |
| OHP | ±1.0 kV |
| LIGHTWEIGHT COATED PAPER | ±0.75 kV |

FIG. 5

| PAPER TYPE | GLOSSY? |
|---|---|
| PLAIN PAPER | N |
| HIGH-GRADE EXCLUSIVE PAPER | N |
| PHOTO PAPER | Y |
| GLOSSY PAPER | Y |
| POSTCARD | N |

FIG. 6

| PAPER TYPE | VOLTAGE |
|---|---|
| PLAIN PAPER | HIGH |
| HIGH-GRADE EXCLUSIVE PAPER | HIGH |
| PHOTO PAPER | LOW |
| GLOSSY PAPER | LOW |
| POSTCARD | HIGH |
| GLOSSY FILM | LOW |
| OHP | HIGH |
| LIGHTWEIGHT COATED PAPER | HIGH |

FIG. 7

| PAPER TYPE | VOLTAGE |
|---|---|
| PLAIN PAPER | ±1.0 kV |
| HIGH-GRADE EXCLUSIVE PAPER | ±1.0 kV |
| PHOTO PAPER | ±0.5 kV |
| GLOSSY PAPER | ±0.5 kV |
| POSTCARD | ±1.0 kV |
| GLOSSY FILM | ±0.75 kV |
| OHP | ±1.0 kV |
| LIGHTWEIGHT COATED PAPER | ±0.75 kV |

RECORDING MEDIUM CONVEYING DEVICE

BACKGROUND OF THE INVENTION

1. Field of the Invention

The present invention relates to a recording medium conveying device of a recording apparatus.

2. Description of the Related Art

A printer (recording apparatus) that records desired information such as characters or an image on a sheet-like recording medium such as paper or a film, has been known as an information output apparatus incorporated in word processors, personal computers, facsimiles, and so forth. Various recording methods used in printers are known. Recently, an ink jet recording method has attracted attention because: non-contact recording can be performed on a recording medium such as paper; the operational cost is low; color printing can be easily performed; and it is noiseless because it is a nonimpact method.

Among ink jet recording apparatuses, specifically, a full-line type recording apparatus that has a plurality of recording heads each having a recording element (nozzle) array corresponding to the recording width and that performs recording while conveying a recording medium, is being widely used because faster recording can be performed. Such a full-line type recording apparatus includes a plurality of recording heads that eject different colors of ink, that are arranged in the recording medium conveying direction, and that can eject ink at the same time so as not to reduce the recording speed even during color recording.

The recording heads of such an ink jet recording apparatus have energy generating elements that generate energy to apply to ink for ejecting ink from ejection ports in the form of droplets, and ink flow passages that have the energy generating elements therein and communicate with the ejection ports. Some of the recording heads have an ink container, such as an ink tank, that contains ink to supply to the energy generating elements through the ink flow passages.

Recording apparatuses are configured to record an image (including characters and signs) on a recording material such as paper or a plastic sheet on the basis of recording information. A laser beam printer (hereinafter referred to as "LBP"), an ink jet printer (hereinafter referred to as "IJP"), and a thermal printer have been put to practical use as a substitute for conventional dot-matrix printers. Recently, an LBP capable of high-resolution and high-grade gradation expression and an IJP capable of photo-quality full-color expression have been put to practical use. With increasing performance of IJPs, to fully elicit the recording performance of the recording apparatuses, high-grade recording media such as glossy paper, a glossy film, and coated paper, and even a medium exclusively for photo quality have been put to practical use. Therefore, IJPs are to be performed recording on various types of recording paper, and as fast as an LBP.

High-speed IJPs have full-line type ink jet recording heads and are configured to be able to perform recording just by conveying a recording medium under the recording heads without moving the recording heads in the direction perpendicular to the recording medium conveying direction as in conventional IJPs. Instead of intermittently conveying a recording medium as in conventional IJPs that move recording heads in the direction perpendicular to the recording medium conveying direction, a recording medium can be continuously conveyed, and therefore high-speed recording can be performed. In addition, high-speed IJPs have a much larger number of nozzles for ejecting ink than conventional IJPs, and therefore the recording area per unit time is large. Therefore, by conveying a recording medium at high speed, recording can be performed at sufficient speed.

Such recording apparatuses generally employ a recording medium conveying device that includes an endless belt member configured to convey a recording medium and provided with conductive electrodes and in which the electrodes are charged to generate electrostatic force, the recording medium is attracted to the belt member, and recording is performed while the recording medium is conveyed. The configuration of a known recording medium conveying device will be described with reference to FIGS. 10 to 12. FIG. 10 is a sectional view of an endless conveying belt member. FIG. 11 is a plan view of the conveying belt member shown in FIG. 10. FIG. 12 shows the configuration of a charging unit that charges the conveying belt member shown in FIGS. 10 and 11.

With reference to FIGS. 10 and 11, a conveying belt 31 serving as an endless belt member is integrally provided with an attraction force generator that includes electrodes 36*a* and 36*b* formed of conductive metal, a base layer 36*c*, a surface layer 36*d*, and voltage receiving members 36*e*. The voltage receiving members 36*e* and the surface layer 36*d* form the same plane. Reference numeral 36*e*1 denotes voltage receiving members for the electrodes 36*a*. Reference numeral 36*e*2 denotes voltage receiving members for the electrodes 36*b*. The conveying belt 31 is supported by a driving roller 34 and a driven roller 32.

In FIG. 12, reference numeral 35 denotes a tension roller that applies tension to the conveying belt 31.

As shown in FIG. 12, a charging unit that charges the conveying belt 31 has a charging brush 51', a charging electrode 52', and a supporting member 53'. The charging brush 51', which supplies a charge, is in contact with the voltage receiving members 36*e*. When a charge is supplied from the charging brush 51' to the voltage receiving members 36*e*, electrostatic force is generated on the conveying belt 31. Thus, constantly-excellent attraction force can be generated on the conveying belt 31.

On the downstream side of the charging brush 51' in the recording medium conveying direction is provided a charge eliminating brush (not shown) that comes into contact with the voltage receiving members 36*e* of the conveying belt 31 and performs charge elimination. By eliminating charge from the conveying belt 31 using this charge eliminating brush and thereby eliminating attraction force, a recording medium can be smoothly separated from the conveying belt 31. Reference numeral 7K denotes an ink jet recording head for black, reference numeral 7C denotes an ink jet recording head for cyan, reference numeral 7M denotes an ink jet recording head for magenta, and reference numeral 7Y denotes an ink jet recording head for yellow.

The above-described known recording medium conveying device is disclosed in Japanese Patent Laid-Open No. 2003-160253.

However, in order to make the endless belt attract a recording medium using electrostatic force, high voltage needs to be applied to the electrodes. In addition, in the case of a recording medium having weak electrostatic attraction force or a recording medium that is hard to attract along the endless belt, the recording medium is hard to bring into close contact with the endless belt, and part of the recording medium is out of contact with the endless belt. In this case, when the recording medium passes under the ink jet recording heads, the recording medium may comes into contact with the bottom surfaces of the ink jet heads and may thereby cause defective recording or damage the recording heads.

The above may be solved by increasing the voltage applied to the electrodes. However, increased voltage is prone to cause leakage of current. The leakage of current may damage the endless belt. If leakage of current occurs between the endless belt and the ink jet recording heads, the leakage of current may damage the ink jet recording heads.

The intensity of electric field generated around the endless belt increases in proportion to the voltage applied to the electrodes. Ink droplets ejected from the ink jet recording heads are susceptible to the electric field. Therefore, ink droplets ejected from the ink jet recording heads are affected by the electric field and miss their predetermined targets on a recording medium. This reduces the quality of the recorded image.

SUMMARY OF THE INVENTION

The present invention provides a recording medium conveying device that prevents a conveying belt and recording heads from being damaged by current leakage, that prevents ink droplets ejected from the recording heads from missing their targets due to the effect of an electric field, and that can satisfactorily conveys the recording medium.

In an aspect of the present invention, an apparatus includes a belt that attracts a recording medium using electrostatic force, a power source unit that applies voltage to the belt, a voltage controller that controls the voltage applied to a charging portion of the belt, and a recording controller that transmits recording medium information on the recording medium to the voltage controller. The voltage controller changes a value of voltage applied to the charging portion, according to the recording medium information transmitted from the recording controller.

Further features of the present invention will become apparent from the following description of exemplary embodiments with reference to the attached drawings.

BRIEF DESCRIPTION OF THE DRAWINGS

FIG. 5 shows a table stored in a recording controller.

FIG. 6 shows a table stored in a recording controller.

FIG. 7 shows a table stored in a recording controller.

DESCRIPTION OF THE EMBODIMENTS

Figure 1:
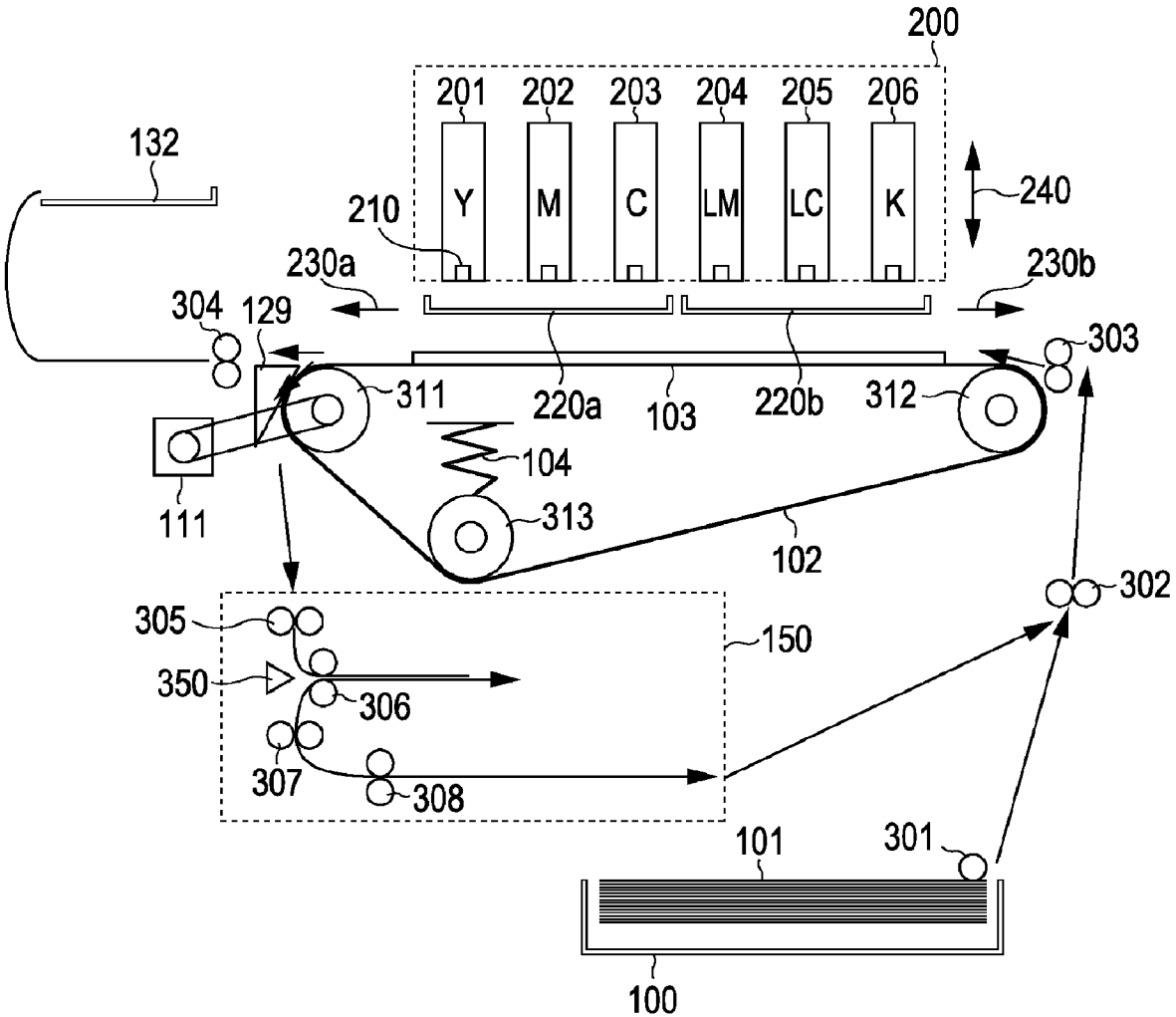
FIG. 1 shows the configuration of a typical ink jet recording apparatus according to an embodiment of the present invention.

FIG. 1 shows the configuration of a typical ink jet recording apparatus. In FIG. 1, a recording paper feeder is configured as follows. Recording media 101 that are sheets of recording paper are held in a paper cassette 100. A pickup roller 301 is a roller for picking up the recording media 101 from the paper cassette 100. A conveying roller 302, a registration roller 303, and an eject roller 304 are rollers for conveying the recording media 101 through a conveyance route. A separation unit 129 separates the recording media 101 from a conveying belt 102. After undergoing recording, recording media 101 are loaded on a reverse side output tray 132.

The conveying belt 102 of the recording medium conveying device is supported by a driving roller 311, a driven roller 312, and a belt slack prevention roller 313. To the driving roller 311, a motor 111 is connected. The rotation of the motor 111 rotates the driving roller 311, which drives the conveying belt 102. A belt slack prevention spring 104 is configured to apply pressure on the belt slack prevention roller 313 so that a constant tension is applied to the conveying belt 102. High-voltage charging portions 103 apply high voltage to the conveying belt 102. The recording media 101 are attracted to the conveying belt 102 due to electrostatic force and are conveyed.

A head unit 200 is located over the conveying belt 102 and has six recording heads in order from the left side of the figure: a sixth ink jet head 201 that is an ink jet recording head for yellow, a fifth ink jet head 202 that is an ink jet recording head for magenta, a fourth ink jet head 203 that is an ink jet recording head for cyan, a third ink jet head 204 that is an ink jet recording head for light magenta, a second ink jet head 205 that is an ink jet recording head for light cyan, and a first ink jet head 206 that is an ink jet recording head for black. The ink jet recording heads 201 to 206 are each provided with a nozzle portion 210. The nozzle portions 210 are capped by cap units 220*a* and 220*b* when recording is not performed. The cap units 220*a* and 220*b* can be opened and closed in the horizontal directions 230*a* and 230*b*. The head unit 200 can be moved in the vertical direction shown by an arrow 240 when the cap units 220*a* and 220*b* are opened or closed.

A duplex reversing mechanism 150 has a reversing mechanism including a pre-reversing roller 305, a reversing roller 306, a post-reversing roller 307, a duplex roller 308, and a path switching unit 350. The duplex reversing mechanism 150 reverses a recording medium 101 that has undergone recording on the conveying belt 102 and sends the recording medium 101 onto the conveying belt 102 again.

Next, the operation of the above ink jet recording apparatus will be described.

Figure 2:
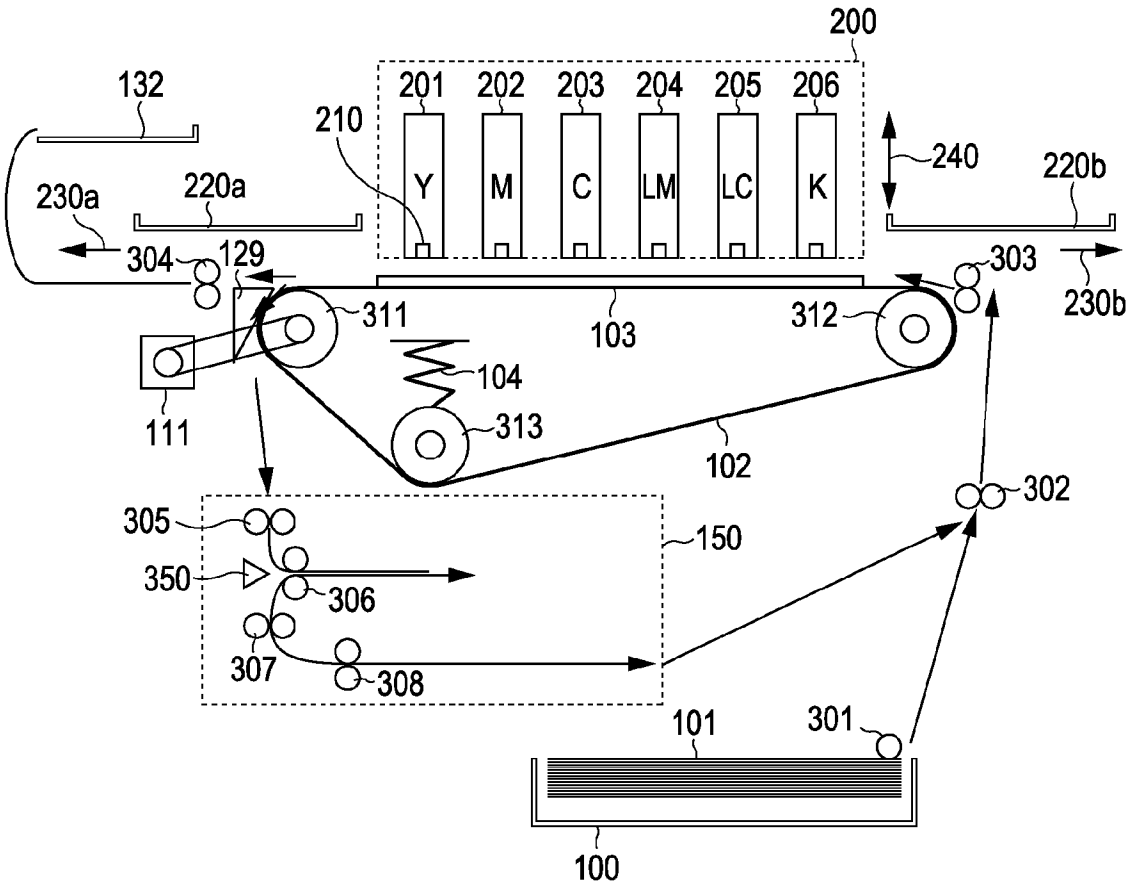
FIG. 2 shows the head unit shown in FIG. 1 lowered to the recordable position.

At the start of a recording operation, the head unit 200 is raised, and the cap units 220*a* and 220*b* are moved leftward and rightward, respectively, so that the nozzle portions 210 are uncapped. Next, the head unit 200 is lowered to the recordable position. FIG. 2 shows the head unit 200 lowered to the recordable position. When conveyance driving energy is given to the conveying belt 102 from the driving motor 111, the conveying belt 102 starts to rotate. The conveying roller 302, the registration roller 303, and the eject roller 304 are given conveyance driving energy by other motors (not shown) and start to rotate.

A recording medium 101 picked up from the paper cassette 100 by the pickup roller 301 is conveyed through the conveying roller 302 and the registration roller 303 onto the conveying belt 102 that is the recording area. At this time, the conveying belt 102 is charged by the high-voltage charging portions 103, and therefore the recording medium 101 is electrostatically attracted by the conveying belt 102. When the recording medium 101 passes under the ink jet recording heads 201 to 206, recording is performed on the recording medium 101 with ink ejected from the ink jet recording heads 201 to 206. After passing under the ink jet recording heads 201 to 206, the recording medium 101 is separated from the conveying belt 102 by the separation unit 129 and is then ejected onto the reverse side output tray 132.

Figure 3:
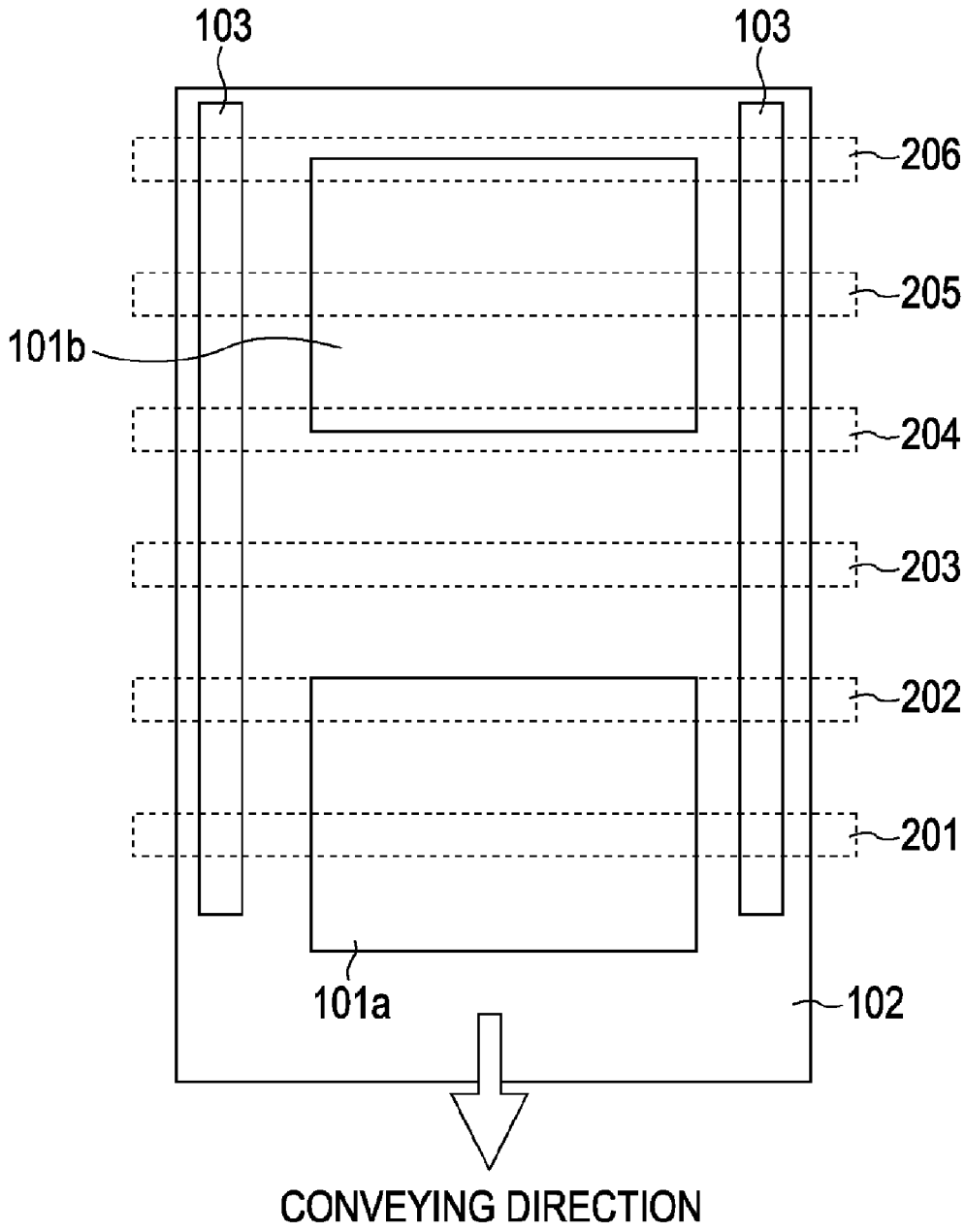
FIG. 3 is a plan view of the conveying belt shown in FIGS. 1 and 2.

FIG. 3 is a plan view of the conveying belt shown in FIGS. 1 and 2. FIG. 3 shows recording media 101*a* and 101*b* that are borne on the conveying belt 102 and are being conveyed under the ink jet recording heads 201 to 206 in the conveying direction of an arrow.

Next, the operation in the case of duplex printing will be described.

Recording is performed with ink ejected from the ink jet recording heads 201 to 206. After passing under the ink jet recording heads 201 to 206, a recording medium 101 is conveyed through the separation unit 129 to the duplex reversing mechanism 150. In the duplex reversing mechanism 150, the recording medium 101 is conveyed through the pre-reversing roller 305 to the reversing roller 306. When the trailing edge of the recording medium 101 has passed through the pre-reversing roller 305, the conveyance of the recording medium 101 is suspended. The path switching unit 350 switches the conveyance route to that to the post-reversing roller 307. Next, the reversing roller 306 is rotated in the opposite direction from that before suspension, and the conveyance of the recording medium 101 is resumed. By this operation, the recording medium 101 is reversed.

After conveyed to the duplex roller 308, the recording medium 101 stops. The time to resume conveyance is determined by the distance to the recording medium 101 in front. After waiting for a predetermined time, conveyance is resumed. After the resumption of conveyance, the recording medium 101 passes through the conveying roller 302 and the registration roller 303 and is then conveyed onto the conveying belt 102 again. After recording is performed on the reverse side, the recording medium 101 is separated from the conveying belt 102 by the separation unit 129, passes through the eject roller 304, and is then ejected onto the reverse side output tray 132.

The embodiments of the present invention will hereinafter be described in detail with reference to the drawings.

In the following embodiments, a printer will be taken as an example of a recording apparatus that employs the ink jet recording method.

In this specification, the term "recording" is not limited to forming significant information such as characters and graphics. Objects of recording need not necessarily be significant. Objects of recording need not necessarily be visible. The term "recording" is defined broadly to include forming an image, a pattern, and so forth on a recording medium and processing a medium.

The term "recording medium" is not limited to paper, which is used in a typical recording apparatus, but includes anything capable of receiving ink, for example, cloth, a plastic film, a metal plate, glass, ceramics, wood, and leather.

As with the above term "recording," the term "ink" is to be understood to have a broad meaning. It includes liquid that is applied to a recording medium for forming an image, a pattern, and so forth, processing a recording medium, or processing ink. As used herein, processing ink means, for example, solidifying or insolubilizing the coloring material in ink applied to a recording medium.

A first embodiment of the present invention will be described.

Figure 4:
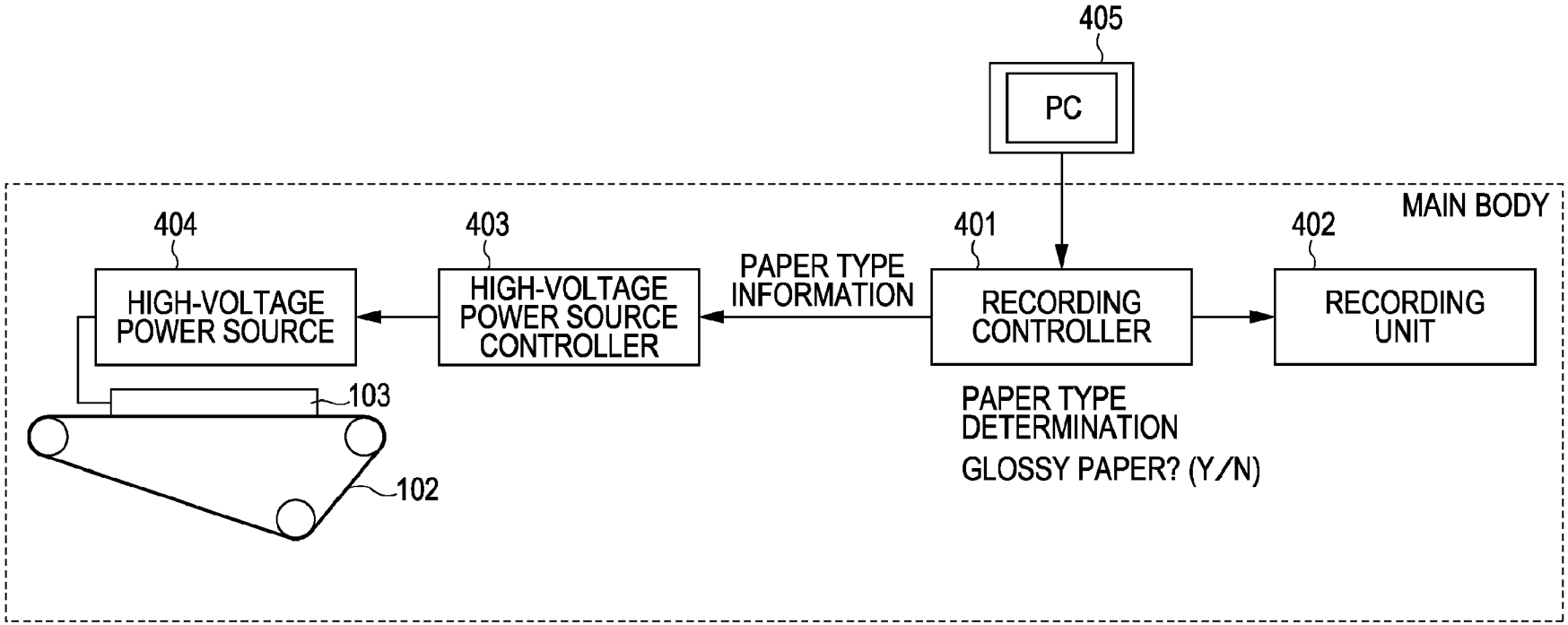
FIG. 4 is a schematic configuration diagram of a first embodiment according to the present invention.

FIG. 4 is a schematic configuration diagram of a first embodiment according to the present invention. A PC 405 is a personal computer for making, processing, and editing a recording image, and it makes print data. The PC 405 is not limited to a computer, and it may be any other device capable of making, processing, and editing a recording image. A recording controller 401 is a controller that converts print data transmitted from the PC 405 into recording data for a recording unit 402. The recording unit 402 is a unit that records characters or an image based on recording data on a recording medium, and it corresponds to the head unit 200 shown in FIG. 1. A high-voltage power source controller 403 is a voltage controller that controls the voltage of a high-voltage power source 404. The high-voltage power source 404 is a unit that applies high voltage to the high-voltage charging portions 103.

Next, the operation will be described. A recording image that is made, processed, or edited in the PC 405 is sent out as print data to the recording controller 401. The print data include not only image data of the recording image made in the PC 405 but also header information such as type of recording medium, paper size, recording quality, and special effect. The information is included in the print mode or condition that the user inputs from the PC 405. The recording controller 401, upon receiving print data, converts image data in the print data on the basis of the header information into data that the recording unit 402 can record. The data are sent out as recording data to the recording unit 402. The recording unit 402 performs recording on a recording medium according to the recording data.

The recording controller 401 stores a table (see FIG. 5) for determining whether the recording medium type information in the header information of the print data indicates glossy paper. The recording controller 401 serving as an information obtaining unit determines whether the type of the recording medium to be subjected to recording is glossy paper, with reference to the table, and obtains information on the glossiness. The result of determination whether the type of the recording medium to be subjected to recording is glossy paper is included in the recording medium information and is sent out to the high-voltage power source controller 403. If the information included in the recording medium information indicates glossy paper, the high-voltage power source controller 403 sets the applied voltage output from the high-voltage power source 404, to ±0.5 kV. If the information included in the recording medium information shows that the recording medium is non-glossy paper, the high-voltage power source controller 403 sets the applied voltage output from the high-voltage power source 404, to ±1.0 kV. As described above, the high-voltage power source controller 403 changes the value of voltage applied by the high-voltage power source 404 to the high-voltage charging portions 103 of the conveying belt 102, according to the recording medium information transmitted from the recording controller 401. When the information that the user inputs from the PC 405 is information from which applied voltage can be determined without requiring the table, the PC 405 can serve as an input unit from which paper type information is input.

It is confirmed that the attraction force between the conveying belt 102 and glossy paper such as photo paper is normally ten or more times stronger than the attraction force between the conveying belt 102 and non-glossy paper. Therefore, even if the voltage applied from the high-voltage power source 404 to the high-voltage charging portions 103 is set to ±0.5 kV, a recording medium can be attracted to the electrostatic attraction belt.

Next, a second embodiment of the present invention will be described.

This embodiment differs from the first embodiment in that the table of recording medium information that the recording controller 401 has is not a table showing whether each type of recording medium is glossy or not but a table showing whether high voltage or low voltage should be applied in the case of each type of recording medium (see FIG. 6).

Next, the operation will be described. A recording image that is made, processed, or edited in the PC 405 is sent out as print data to the recording controller 401. The print data include not only image data of the recording image made in the PC 405 but also header information such as type of recording medium, paper size, recording quality, and special effect. The recording controller 401, upon receiving print data, converts image data in the print data on the basis of the header information into data that the recording unit 402 can record. The data are sent out as recording data to the recording unit 402. The recording unit 402 performs recording on a recording medium according to the recording data.

The recording controller 401 has a table (see FIG. 6) for determining whether high voltage or low voltage should be applied from the recording medium type information in the header information of the print data. The recording controller 401 determines whether high voltage or low voltage should be applied. The result of determination is included in the recording medium information and is sent out to the high-voltage power source controller 403. If the information included in the recording medium information indicates that low voltage should be applied, the high-voltage power source controller 403 sets the applied voltage output from the high-voltage power source 404, to ±0.5 kV. If the information included in the recording medium information indicates that high voltage should be applied, the high-voltage power source controller 403 sets the applied voltage output from the high-voltage power source 404, to ±1.0 kV. As described above, the high-voltage power source controller 403 changes the value of voltage applied by the high-voltage power source 404 to the high-voltage charging portions 103 of the conveying belt 102, according to the recording medium information transmitted from the recording controller 401.

Next, a third embodiment of the present invention will be described.

This embodiment differs from the first and second embodiments in that the table of paper type information that the recording controller 401 has shows how many volts is the applied voltage output from the high-voltage power source 404 in the case of each type of recording medium.

Next, the operation will be described. A recording image that is made, processed, or edited in the PC 405 is sent out as print data to the recording controller 401. The print data include not only image data of the recording image made in the PC 405 but also header information such as type of recording medium, paper size, recording quality, and special effect. The recording controller 401, upon receiving print data, converts image data in the print data on the basis of the header information into data that the recording unit 402 can record. The data are sent out as recording data to the recording unit 402. The recording unit 402 performs recording on a recording medium according to the recording data.

The recording controller 401 sends out recording medium information to the high-voltage power source controller 403 on the basis of the recording medium type information in the header information of the print data so that an applied voltage determined in the table of FIG. 7 according to the type of recording medium is output from the high-voltage power source 404. The high-voltage power source controller 403 performs control so that the voltage value received as paper type information is output from the high-voltage power source 404. As described above, the high-voltage power source controller 403 changes the value of voltage applied by the high-voltage power source 404 to the high-voltage charging portions 103 of the conveying belt 102, according to the recording medium information transmitted from the recording controller 401.

Next, a fourth embodiment of the present invention will be described.

In the fourth embodiment, the type of a recording medium is determined from the smoothness of the recording medium. The table of paper type information that the recording controller 401 has includes the previously obtained value of smoothness of each type of recording medium.

Next, the operation will be described. A recording image that is made, processed, or edited in the PC 405 is sent out as print data to the recording controller 401. The print data include not only image data of the recording image made in the PC 405 but also header information such as type of recording medium, paper size, recording quality, and special effect. The recording controller 401, upon receiving print data, converts image data in the print data on the basis of the header information into data that the recording unit 402 can record. The data are sent out as recording data to the recording unit 402. The recording unit 402 performs recording on a recording medium according to the recording data.

The recording controller 401 has a table of smoothness (not shown) associated with the type of recording medium in the header information of the print data. The smoothness of the recording medium to be subjected to recording is sent out as recording medium information to the high-voltage power source controller 403. If the smoothness of the recording medium included in the recording medium information is 2,000 seconds or more, the high-voltage power source controller 403 sets the applied voltage output from the high-voltage power source 404, to ±0.5 kV. If the smoothness of the recording medium included in the recording medium information is less than 2,000 seconds, the high-voltage power source controller 403 sets the applied voltage output from the high-voltage power source 404, to ±1.0 kV. As described above, the high-voltage power source controller 403 changes the value of voltage applied by the high-voltage power source 404 to the high-voltage charging portions 103 of the conveying belt 102, according to the recording medium information transmitted from the recording controller 401.

The high-voltage power source controller 403 may set the applied voltage output from the high-voltage power source 404 according to the level of smoothness. For example, if the smoothness is 2,000 seconds or more, the applied voltage is set to ±0.5 kV. If the smoothness is 1,000 seconds or more but less than 2,000 seconds, the applied voltage is set to 1 kV. If the smoothness is less than 1,000 seconds, the applied voltage is set to 2 kV.

Figure 8:
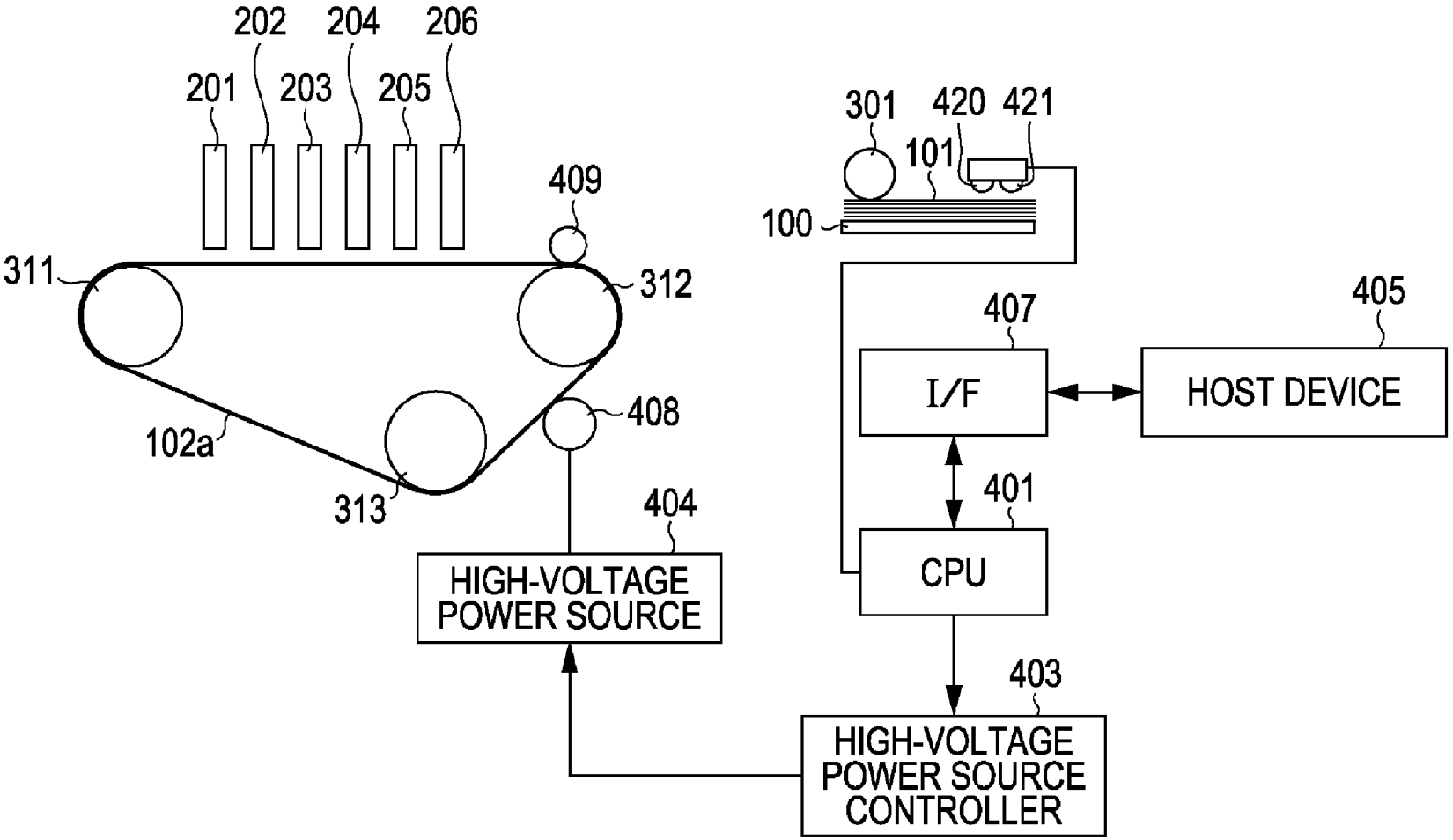
FIG. 8 shows the configuration of a fifth embodiment of the present invention.

FIG. 8 shows a fifth embodiment of the present invention. The same reference numerals will be used to designate the same components as those in FIGS. 1 and 4, and the redundant description will be omitted. The conveying belt 102*a* of FIG. 8 does not have electrodes, and the surface that attracts a recording medium is formed of a high-resistance and high-dielectric polymeric material. Reference numeral 408 denotes a charging roller serving as a voltage applying unit that applies voltage to the conveying belt 102*a* and charges the conveying belt 102*a*. The surface of the conveying belt to which high voltage is applied by the charging roller 408 can attract a recording medium due to electrostatic force.

Reference numeral 405 denotes a host device 405, such as a personal computer, which generates a print instruction and sends the print instruction to the recording unit 402. Reference numeral 407 denotes an interface that receives information from the host device 405. Reference numeral 401 denotes a CPU serving as a control unit. Reference numeral 409 denotes a pinch roller that presses a recording medium fed by a paper feed roller 301 against the conveying belt 102*a*.

Also in the fifth embodiment, paper type information is included in the print information sent from the host device 405.

Reference numeral 420 denotes a light source, which is a light emitter that irradiates the surface of a recording medium 101 loaded in a cassette 100. Reference numeral 421 denotes a photodetector that detects the light emitted from the light emitter 420 and reflected by the surface of the recording medium 101. From the amount of reflected light that the photodetector 421 detects, the CPU determines the smoothness and the glossiness of the surface of the recording medium 101. A reading unit, such as a CCD sensor, that reads the image of the surface of the recording medium 101 may be substituted for the photodetector 421. From the image information of the surface of the recording medium that the CCD sensor 421 has read, the CPU determines the smoothness and the glossiness of the surface of the recording medium 101. The light emitter 420 and the photodetector 421 constitute an obtaining unit that obtains the information on the recording medium as well as a sensor that detects the type of paper.

Figure 9:
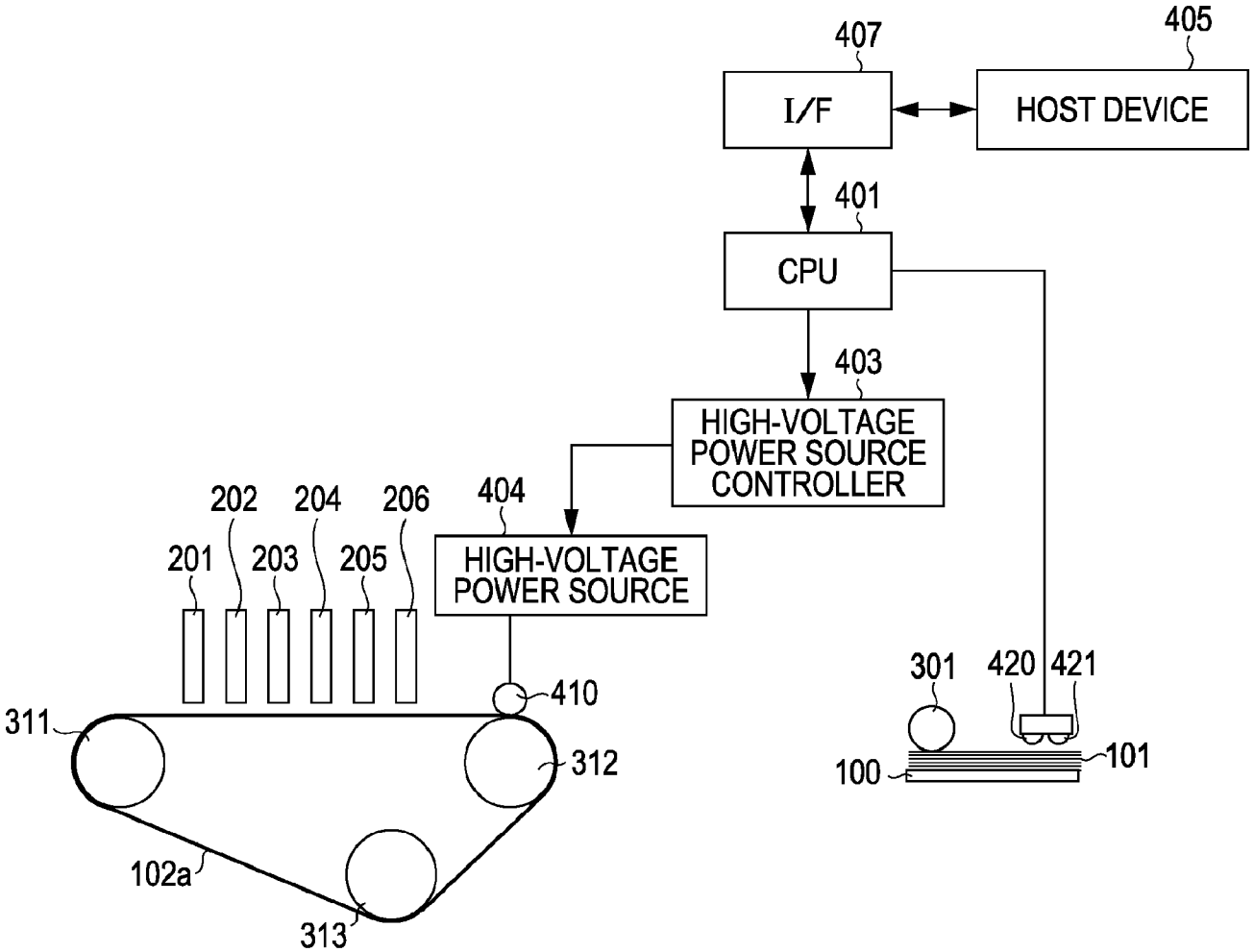
FIG. 9 shows the configuration of a sixth embodiment of the present invention.
Figure 10:
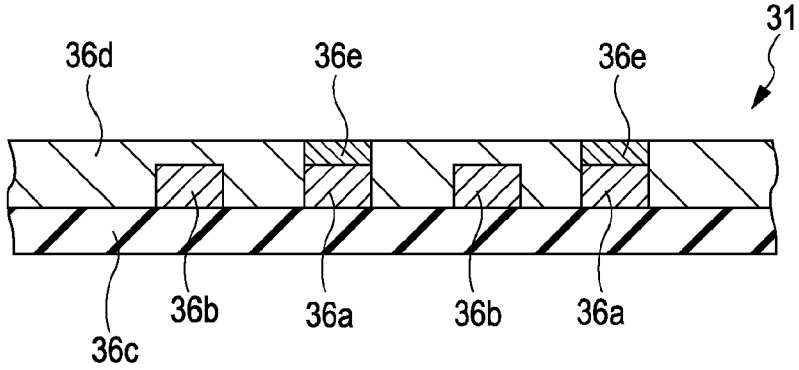
FIG. 10 is a sectional view of a known endless conveying belt member.
Figure 11:
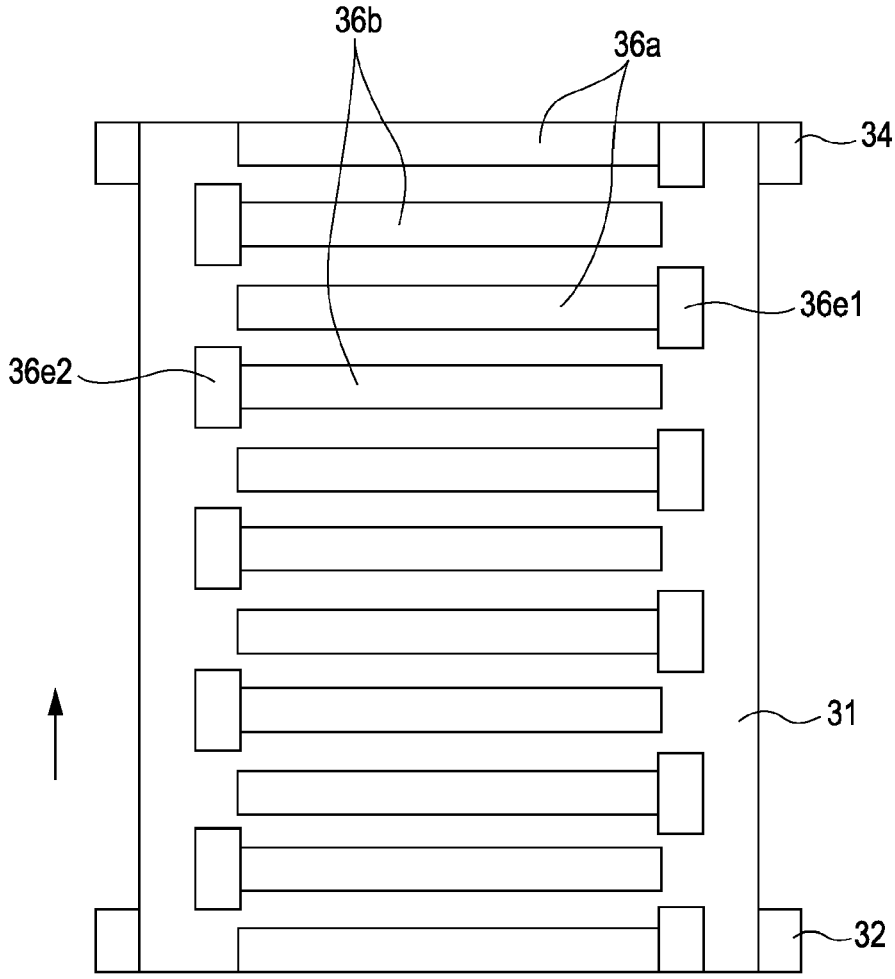
FIG. 11 is a plan view of a known conveying belt member.
Figure 12:
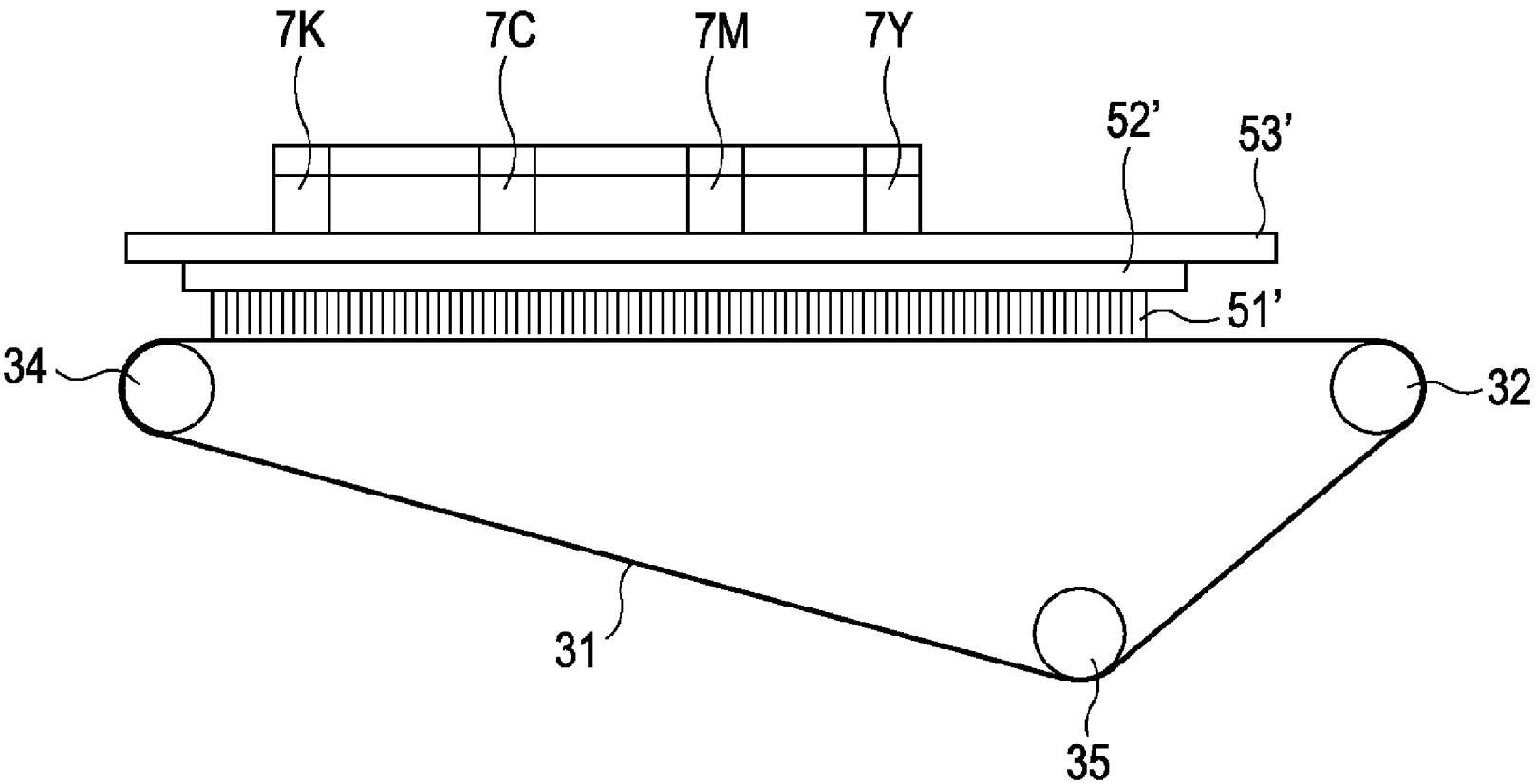
FIG. 12 shows the configuration of a charging unit that charges a known conveying belt member.

FIG. 9 shows a sixth embodiment of the present invention. In the sixth embodiment, a charging roller 410 doubles as a pinch roller. The charging roller 410 applies high voltage to a conveying belt 102*a* through a recording medium. Except for this, the sixth embodiment is the same as the fifth embodiment.

As described above, according to the above embodiments, the voltage applied to the electrodes of the electrostatic attraction belt is set according to the type of recording medium. For example, in the case of a recording medium having weak electrostatic attraction force, high voltage is applied to the electrodes of the electrostatic attraction belt. In the case of a recording medium having strong electrostatic attraction force, low voltage is applied to the electrodes of the electrostatic attraction belt. Therefore, a recording medium can be attracted to the electrostatic attraction belt with no space between and can be satisfactorily conveyed. In addition, minimum voltage can be applied according to the type of recording medium, and therefore the electric field arising from the electrostatic attraction belt can also be minimized. Consequently, the electrostatic attraction belt and the ink jet recording heads can be prevented from being damaged by the leakage. In addition, ink droplets ejected from the ink jet recording heads can be prevented from missing their targets due to the effect of the electric field. Therefore, the reduction in quality of the recorded image can be prevented.

Recording media may be classified into glossy paper and non-glossy paper. In the case of glossy paper, the voltage applied to the electrodes of the electrostatic attraction belt is decreased. In the case of non-glossy paper, the voltage applied to the electrodes of the electrostatic attraction belt is increased. Therefore, a recording medium can be attracted to the electrostatic attraction belt with no space between and can be satisfactorily conveyed. In general, glossy paper is used for recording purpose requiring high image quality, such as photographic printing. Glossy paper has strong electrostatic attraction force compared to non-glossy paper. In the case of glossy paper, by decreasing the voltage applied to the electrodes of the electrostatic attraction belt, ink droplets ejected from the ink jet recording heads can be prevented from missing their targets due to the effect of the electric field. Therefore, higher quality image recording can be performed.

Alternatively, recording media may be classified according to their surface smoothness. If the smoothness is high (2,000 seconds or more), the voltage applied to the electrodes of the electrostatic attraction belt is decreased. If the smoothness is low (less than 2,000 seconds), the voltage applied to the electrodes of the electrostatic attraction belt is increased. Therefore, a recording medium can be attracted to the electrostatic attraction belt with no space between and can be satisfactorily conveyed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-160298 filed Jun. 19, 2008, which is hereby incorporated by reference herein in its entirety.

What is claimed is:

1. An apparatus comprising:

a belt that attracts a recording medium using electrostatic force;

a power source unit that applies voltage to the belt;

a voltage controller that controls the voltage applied to a charging portion of the belt; and a recording controller that transmits recording medium information on the recording medium to the voltage controller, wherein the voltage controller changes a value of voltage applied to the charging portion, according to the recording medium information transmitted from the recording controller, wherein the recording medium information includes information on whether or not the recording medium is glossy paper, and wherein the voltage controller sets the voltage applied to the charging portion to a predetermined voltage if the recording medium is glossy paper, and sets the voltage applied to the charging portion to a voltage higher than the predetermined voltage if the recording medium is not glossy paper.

2. The apparatus according to claim 1, wherein the recording medium information includes information on the smoothness of the recording medium.

3. The apparatus according to claim 2, wherein the voltage controller sets the voltage applied to the charging portion to a predetermined voltage if the smoothness of the recording medium is 2,000 seconds or more, and sets the voltage applied to the charging portion to a voltage higher than the predetermined voltage if the smoothness of the recording medium is less than 2,000 seconds.

4. An apparatus comprising:

a belt that attracts a recording medium using electrostatic force and conveys the recording medium;

an information obtaining unit that obtains information on the recording medium; and a voltage controller that controls the voltage applied from a power source to the belt, according to the obtained information, wherein the recording medium information includes information on whether or not the recording medium is glossy paper, and wherein the voltage controller sets the voltage applied to the charging portion to a predetermined voltage if the recording medium is glossy paper, and sets the voltage applied to the charging portion to a voltage higher than the predetermined voltage if the recording medium is not glossy paper.

5. The apparatus according to claim 4, wherein the information is information on the smoothness of the surface of the recording medium.

6. The apparatus according to claim 4, wherein the information obtaining unit is an input unit from which paper type information is input.

7. The apparatus according to claim 4, wherein the information obtaining unit is a sensor that detects a paper type.

8. The apparatus according to claim 7, wherein the sensor has a light source that irradiates a surface of the recording medium, and a reading unit that reads a reflected light of the light source reflected by the surface.

9. The apparatus according to claim 7, wherein the sensor has a light source that irradiates a surface of the recording medium, and a photodetector that detects the reflected light of the light source reflected by the surface.

* * * * *